US005924637A

United States Patent [19]

Niederholtmeyer

[11] Patent Number: 5,924,637

[45] **Date of Patent: *Jul. 20, 1999**

[54] OVERSIZE TIRE AND RUBBER DEBRIS SHREDDER

[76] Inventor: Werner Niederholtmeyer, 7804 Fritz Rd., Fort Wayne, Ind. 46818

[ * ] Notice: This patent is subject to a terminal disclaimer.

[21] Appl. No.: 08/843,696

[22] Filed: Apr. 16, 1997

[51] Int. Cl.[6] ..... B02C 19/12

[52] U.S. Cl. ..... 241/186.35; 241/277; 241/280; 241/283; 241/DIG. 31

[58] Field of Search ..... 241/186.35, 277, 241/236, 283, DIG. 31, 286, 280

[56] References Cited

U.S. PATENT DOCUMENTS

| | | | |
|---|---|---|---|
| 1,372,001 | 3/1921 | Antoine . | |
| 2,559,701 | 7/1951 | Becker . | |
| 2,705,985 | 4/1955 | Starling . | |
| 3,721,392 | 3/1973 | Burwell | 241/301 |
| 3,825,192 | 7/1974 | Knight | 241/186.35 |
| 3,913,850 | 10/1975 | Daniel | 241/101.7 |
| 4,015,782 | 4/1977 | Granite | 241/62 |
| 4,119,277 | 10/1978 | Snyder et al. | 241/167 |
| 4,142,688 | 3/1979 | Johnson | 241/236 |
| 4,180,004 | 12/1979 | Johnson | 110/346 |
| 4,223,845 | 9/1980 | Selonke et al. | 241/34 |
| 4,374,573 | 2/1983 | Rouse et al. | 241/101 |
| 4,394,983 | 7/1983 | Ulsky | 241/243 |
| 4,509,700 | 4/1985 | Svengren | 241/280 |
| 4,625,924 | 12/1986 | Killinger | 241/186.35 |
| 4,684,071 | 8/1987 | Dicky | 241/80 |
| 4,723,717 | 2/1988 | Fagnant | 241/222 |
| 4,796,821 | 1/1989 | Pao et al. | 241/101.2 |
| 4,836,458 | 6/1989 | Cavagna | 241/101.2 |
| 4,927,088 | 5/1990 | Brewer | 241/223 |
| 5,230,475 | 7/1993 | Gerner | 241/34 |
| 5,299,748 | 4/1994 | Brewer | 241/279 |
| 5,375,775 | 12/1994 | Keller et al. | 241/19 |
| 5,678,774 | 10/1997 | Bennett et al. | 241/27 |
| 5,782,417 | 7/1998 | Niederholtmeyer | 241/277 |

*Primary Examiner*—John M. Husar
*Attorney, Agent, or Firm*—Paul W. O'Malley; Susan L. Firestone

[57] ABSTRACT

The tire shredder includes a frame, a conveyor assembly depending from the frame defining a feed path for the tires and debris from an input end to a discharge end, a carriage supported with respect to the conveyor assembly to have a reciprocating linear travel across the linear feed path at the discharge end, and a plurality of rotary cutting elements mounted on the carriage with axes of rotation parallel to the travel of the carriage. By providing a plurality of rotary cutting elements tires coming in a wide variety of sizes can be handled. The conveyor assembly further comprises a support conveyor having a substantially planar conveying surface for carrying tires, a compression conveyor positioned above the support conveyor, a suspension system depending from the frame supporting the compression conveyor in a position generally facing the compression conveyor with the support conveyor and the compression conveyor being closer at the discharge end than at the input end and a position control strut for urging the compression conveyor in a selected direction toward or away from the support conveyor.

10 Claims, 12 Drawing Sheets

OVERSIZE TIRE AND RUBBER DEBRIS SHREDDER

CROSS-REFERENCE TO RELATED APPLICATION

This Application is related to pending application Ser. No. 08/738,027 filed Oct. 25, 1996, now U.S. Pat. No. 5,782,417 which is expressly incorporated herein by reference.

BACKGROUND OF THE INVENTION

The present invention relates to an apparatus for shredding automobile tires and more particularly to providing a compact and inexpensive tire shredder capable of handling both oversize tires and tire or tire recap fragments.

Used tires present many difficulties for recycling despite the many uses that can be made of the basic materials in the tires. For most uses, whole tires are not acceptable and the tires must be reduced to particles, or powder, for use. Generally, the finer the particles into which the tire is cut the more possibilities there are for recycling. Tires are, of course, made to be highly durable, particularly with respect to resisting cutting, which has forced recyclers to use large, expensive, heavy duty machinery to reduce used tires to small particles.

Large, heavy duty machinery is expensive and is efficiently used by only those who have a large, steady supply of used tires. The primary source of used tires is automobiles, and, more particularly, the tire stores where drivers have their autos maintained. Many such stores are not large enough to make efficient use of the heavy duty machinery previously required to reduce tires to powder. Thus, many stores store used tires until collecting enough to ship to a centralized recycling facility.

Tires are bulky relative to weight, which makes the storage of used tires inside difficult because of the large space required. The outdoor storage of used tires, while done, fosters health risks from water collecting inside the tires and providing a breeding ground for mosquitos. Storing used tires poses fire dangers both by providing a fuel source and because they produce heavy smoke when burning. The same bulkiness which makes tires inefficient to store also makes them relatively expensive to ship. A truck fully loaded with tires travels at far below its weight capacity.

The recycling of tires would be eased if they could be reduced at the source, since converting the tires to particles aids not only recycling, but also reduces the space requirements for shipping and storing.

Some inventors have tried to deal with this problem by making tire shredding equipment transportable. For example, U.S. Pat. Nos. 5,375,775 to Keller, et al. 4,374,573 to Rouse et al., 4,180,004 to Johnson, and 3,913,850 to Daniel are all directed to transportable machines providing the fine reduction of tires for recycling. After use, both the machinery and the debris must be removed. The patents do not address the storage problem of small and medium sized shops.

Applicant, in his application for patent on a Tire Shredder, application Ser. No. 08/738,027 filed Oct. 25, 1996 now U.S. Pat. No. 5,782,417, which is not admitted to be prior art with respect to the invention by its mention in this background section, provides an apparatus for shredding automobile tires of conventional ranges in size. The tire shredder is mounted in a support frame. The frame supports two parallel, vertically spaced rails on which are mounted a wheeled carriage. A variable speed, bidirectional motor provides reciprocating movement of the wheeled carriage parallel to the floor with the travel of the carriage limited by opposed relays, which are thrown by movement of the carriage. The wheeled carriage supports a cutting assembly which includes a drive motor and a drive shaft set parallel to the travel of the carriage having a plurality of circular saws mounted thereon. Tires are fed to the circular saws by a conveyer system. Bottom and top conveyers are constructed from T-bars set across parallel chains for gripping and urging tires into the saws. The bottom conveyer carries the tires substantially parallel to the floor. The top conveyor, substantially identical to the first., is positioned directly above the first conveyer, slanting downwardly toward the bottom conveyor from the opening for the tires to the discharge point adjacent the saws. The downward slope serves to compress the tires as they move toward the saws. The conveyers are driven by a variable speed motor. Yet another conveyer belt may be provided on to which tires may be thrown and carried into the cooperating top and bottom conveyers which feed the saws. A compact tire shredder able to handle debris and large tires is still needed for some applications.

SUMMARY OF THE INVENTION

It is an object of the invention to provide a simple, low cost apparatus for reducing tires, particularly oversize tires and tire shreds to an average particulate size convenient for storage, shipping and recycling.

It is a further object of the invention to provide a tire shredder constructed from common parts for ease of maintenance.

It is a still further object of the invention to provide a compact tire shredder.

The invention provides an apparatus for shredding tires and tire debris. The tire shredder includes a frame, a conveyor assembly depending from the frame defining a feed path for the tires and debris from an input end to a discharge end, a carriage supported with respect to the conveyor assembly to have a reciprocating linear travel across the linear feed path at the discharge end, and a plurality of rotary cutting elements mounted on the carriage with axes of rotation parallel to the travel of the carriage. By providing a plurality of rotary cutting elements tires coming in a wide variety of sizes can be handled. The conveyor assembly further comprises a support conveyor having a substantially planar conveying surface for carrying tires, a compression conveyor positioned above the support conveyor, a suspension system depending from the frame supporting the compression conveyor in a position generally facing the compression conveyor with the support conveyor and the compression conveyor being closer at the discharge end than at the input end and a position control strut for urging the compression conveyor in a selected direction toward or away from the support conveyor.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
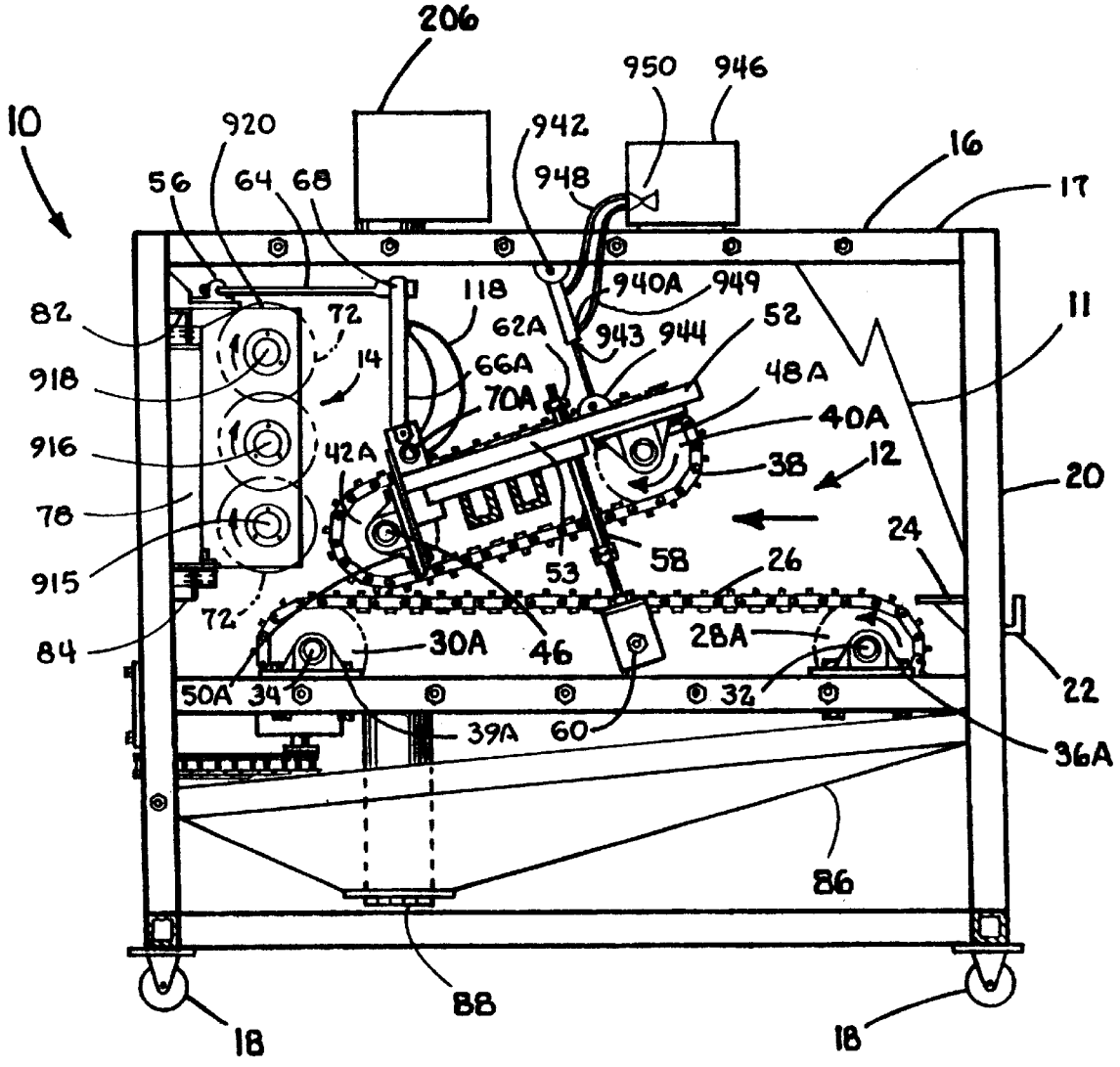
FIG. 1 is a side cutaway view of a first embodiment of the tire shredder in accordance with the invention.

Referring now to the Figures wherein like numbers refer to similar parts and particularly to FIG. 1, a tire shredder 10 is illustrated. Tire shredder 10 is a compact machine preferably measuring fewer than two meters in any dimension: height; width; or depth. Tire shredder 10 reduces worn automobile tires to shreds and powder by transporting and compressing tires through a conveyor system 12 into a rotary cutting assembly 14 set across the discharge end of the conveyor system. The assembly of the conveyor system 12 and the rotary cutting assembly 14 are held on a compact box frame 16. Box frame 16 may be mounted on wheels 18 placed at each of four corners to allow easy repositioning of tire shredder 10 on a floor. In use a cover 11 shields the interior assembly.

The feed direction of tires into and through conveyor system 12 is indicated by an arrow pointing from right to left in FIG. 1. Tires are introduced to conveyor system 12 through a side 20 of frame 16 adjacent a ledge hook 22. Tires are placed on to a shelf 24 and a bottom or support conveyor 26, or onto an external feed conveyor or support mounted to ledge hook 22. Ledge hook 22 is bolted to frame 16 for ease of removal if no external feed conveyor is used. Support conveyor 26 is one of two conveyors and is trained between sprockets 28A and 30A, which are mounted on shafts 32 and 34, respectively. Shafts 32 and 34 are mounted for rotation in bearing packs 36 and 38, respectively, and shaft 32 is driven in the counterclockwise direction drive conveyor 26 in the direction of the arrow and to urge tires into engagement with an upper or compression conveyor 38. A motor drives support conveyor 26 through shaft 32 and sprocket 28A.

Rotary cutting assembly 14 works best if tires are substantially flattened as they are fed to it. The overhead compression conveyor 38 is set at an angle relative to support conveyor 26 to provide minimum spacing between conveyors 26 and 38 at the point of discharge of tires from conveyor system 12 and thereby progressively flattening the tires as they move through conveyor system 12. The angle between conveyors 26 and 38 is selected to provide sufficient spacing between the conveyors at the input end to allow tires or debris to be engaged by both conveyors before flattening begins.

Locomotion of conveyors 26 and 38 is provided by a motor and drive train. Conveyor 38 is trained between sprockets 40A and 42A, and 40B and 42B, respectively. Sprockets 40A and 40B are mounted on shaft 44 and sprockets 42A and 42B are mounted on shaft 46. Shaft 44 is driven in the clockwise direction as viewed in FIG. 1, so that conveyor 38 cooperates with conveyor 26 in urging tires toward rotary cutting assembly 14. Compression conveyor 38 is trained on four sprockets, including sprockets 40A and 42A. Sprockets 40A and 42A are mounted on shafts 44 and 46, respectively, which are in turn mounted for rotation in bearing blocks 48A and B and 50A and B, respectively. Bearing blocks 48A and B and 50A and B are attached to a rigid subframe 52 to fix the position of conveyor 38 on subframe 52. The same motor may be used to drive conveyors 26 and 38 as described below.

Conveyors 26 and 38 require substantial longitudinal and latitudinal rigidity to compress tires without deforming themselves. The position of support conveyor 26 is fixed relative to frame 16 since bearing blocks 36A, 36B and 39A and 39B for shafts 32 and 34, respectively, are mounted directly to frame 16.

Conveyor system 12 handles tires in a variety of sizes. Compression conveyor 38 is mounted on a subframe 52, which provides attachment points for supporting the subframe from frame 16. The positioning of subframe 52 is spring biased to allow tire shredder 10 to handle tires of differing sizes. Specifically, subframe 52 provides for support at four points spaced along the sides of the subframe. Support at two points along opposite edges of subframe 52 is provided by attachment of the subframe to opposite ends of a stabilizer bar 54. Stabilizer bar is supported from frame 16 at an attachment point 56. Stabilizer bar 54 can bend to allow some variation in the minimum spacing between support conveyor 26 and compression conveyor 38 while keeping the spacing even from side to side. Stabilizer bar 54 includes three parts, a torsion bar 64 and two pivoting plastic connecting ties 66A and 66B. Torsion bar 64 is connected to connecting ties 66A and 66B (not shown) at pivots 68, and the ties connect to subframe 52 at pivots 70A and B (not shown). Opposite sides of subframe 52 are supported by pivoting support rods 58A and 58B. The pivot points 60A and 60B (not shown) for rods 58A and 58B are set below the working face of conveyor 26 on a leg of frame 16. Rods 58A and 58B may be spring loaded between retaining nuts 62A and 62B (not shown) and subframe 52.

The gap between support conveyor 26 and compression conveyor 38 may be adjusted, on both the input side and the discharge side, to accommodate differing tire sizes. As previously noted, overhead compression conveyor 38 is set at an angle relative to support conveyor 26 to provide minimum spacing between conveyors 26 and 38 at the point of discharge of tires from conveyor system 12 and thereby progressively flattening the tires as they move through conveyor system 12. Two adjustment struts 940A and B (not shown) are attached between toprails 53 of subframe 52 and rails 17 of frame 16. Subframe 52 provides pivot attachment points 944 on rails 17 to permit attachment of adjustment struts 940A and B between the subframe and attachment points 942 on frame 16. Adjustment struts 940A and B comprise a conventional two chamber cylinder and piston arrangement for retraction and extension. A compressed air source 946, such as a pump or compressed air tank, delivers compressed air to a selectable chamber by valve 950 and hoses 948 and 949. Valve 950 may also be used to regulate pressure to control the degree of extension or retraction of struts 940A and B. Extension of adjustment struts 940A and B urges subframe 52 toward support conveyor 26. This may be particularly important if tire fragments or debris are being processed rather than whole tires. Alternatively, adjustment struts 940A and B may be retracted to urge subframe 52 upwardly, increasing the space between compression conveyor 38 and support conveyor 26. This feature may be useful if material jams in tire shredder 10 and requires removal.

Tires, as they emerge from between conveyors 26 and 38, are fed directly into rotary cutting assembly 14. Rotary cutting assembly 14 includes a carriage 78. Carriage 78 is carried by wheels 80 along tracks 82 and 84. Tracks 82 and 84 are arranged parallel to one another and the floor with track 82 being directly over track 84. Carriage 78 reciprocates on tracks 82 and 84 across the discharge end of conveyor system 12 exposing different portions of compressed debris being fed into the rotary cutting assembly 14 to the cutting edges of circular saws 72. Rotary cutting assembly 14 comprises a plurality of parallel shafts (here three shafts 915, 916 and 918) each carrying a plurality of circular saws 72. Parallel shafts 915, 916 and 917 are set for rotation in a frame assembly 920 extending from carriage 78. Shafts 915, 916 and 918 are mounted on carriage 78 with the axes of rotation parallel to the travel of the carriage. An alternative arrangement of the rotary cutting assembly uses two parallel shafts (illustrated below). Shafts 915, 916 and 918 are arranged in a plane, which is perpendicular to the to the upper moving surface of support conveyor 26 at the point of discharge of material from conveyor system 12. The number of shafts employed in rotary cutting assembly 14 depends upon the size of tires to be processed by a given tire shredder 10. As increasing tire size forces support conveyor 26 and compression conveyor 38 apart and the tires engage, the vertically higher rows of circular saws for cutting. Shafts 915, 916 and 918 are mechanically linked and all rotate in the same direction as indicated by the arrows with circular saws 72 tearing tires and debris downwardly so the circular saws are worked back and forth across a working surface on the debris.

Shredded material is collected for disposition in a chute 86, which is open at the bottom to allow attachment of a collection bag or hose. Extending from opening 87 at the bottom of chute 86 is an outlet for pipe 88 from blower 206. The air stream ejected from pipe 88 is intended to entrain small particulate material in a fluid stream for removal.

Figure 2:
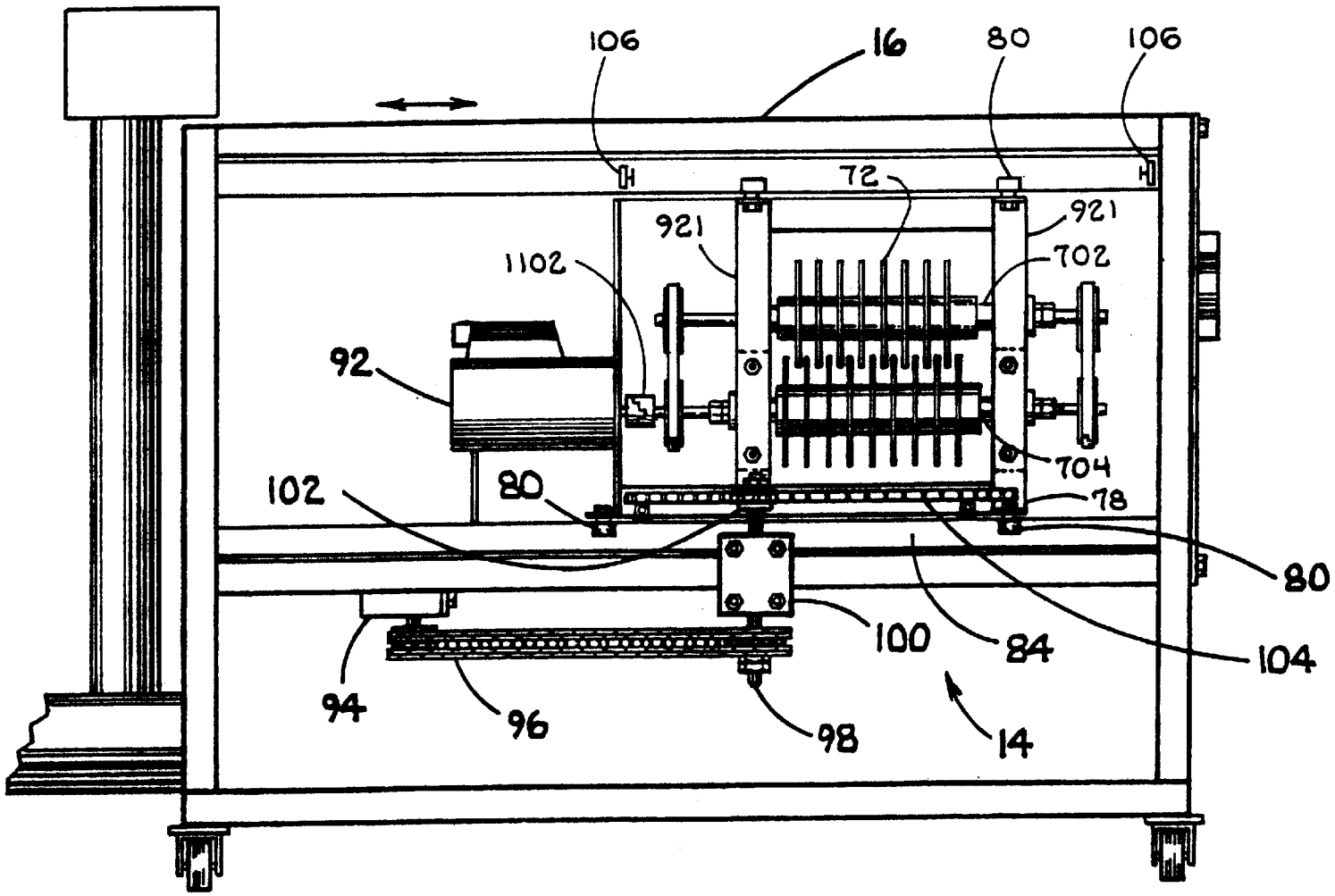
FIG. 2 is a rear cutaway view of a second embodiment of the tire shredder.

Referring now to FIG. 2, rotary cutting assembly 14, incorporating two shafts 702 and 704, is shown. The primary features of rotary cutting assembly 14 are a carriage 78 and a plurality of rotatable shafts (here two shafts, 702 and 704 are shown with shaft 702 disposed above shaft 704). Reciprocation of carriage 78 (in the directions shown by the arrows) is provided by making the carriage moveable on wheels 80 set in parallel tracks 82 and 84. Tracks 82 and 84 are in turn mounted to frame 16. A reversible drive motor 94 (shown in FIG. 9) moves carriage 78 by a rack and pinion drive system. Power is coupled from motor and gear box assembly 94 to a chain 96, which in turn drives a shaft 98 mounted for rotation in a bearing block 100 mounted on frame 16. A pinion 102 is set on one end of shaft 98 to engage a rack 104, which is attached to carriage 78. Motor and gear box assembly 94 changes direction when wheels 80 collide with motor reversing relays 106 attached to opposite ends of rail 82. Thus carriage 78 reciprocates on a linear travel defined by rails 82 and 84.

Shafts 702 and 704 are mounted for rotation in frame supports 920 and 921 of carriage 78. A plurality of circular saws 72 are radially mounted on each of shafts 702 and 704 between frame supports 920 and 921. The circular saws 72 on each shaft are mutually spaced by a plurality of spacers 90 set between the saws. Circular saws 72 are illustrated as mounted perpendicular to each of shafts 702 and 704 and are held in an evenly spaced relationship one to the next. Circular saws 72 are preferably uniform in diameter and overlap saws on adjacent shafts, extending into the interstices formed between saws on an adjacent shaft by spacers 90. An alternating current electric motor is mounted on carriage 78 and is directly coupled by coupler 1102 to drive shaft 704, which is linked by drive belts 962 to shaft 702, as described in more detail below.

Reciprocation of carriage 78 moves circular saws 72 back and forth across the discharge point of material from the feed path defined by conveyor system 26. Reciprocation of carriage 78 results in the point of contact between circular saws 72 and the tires constantly changing by a small amount. The result is that the tires are effectively converted to powder.

Figure 3:
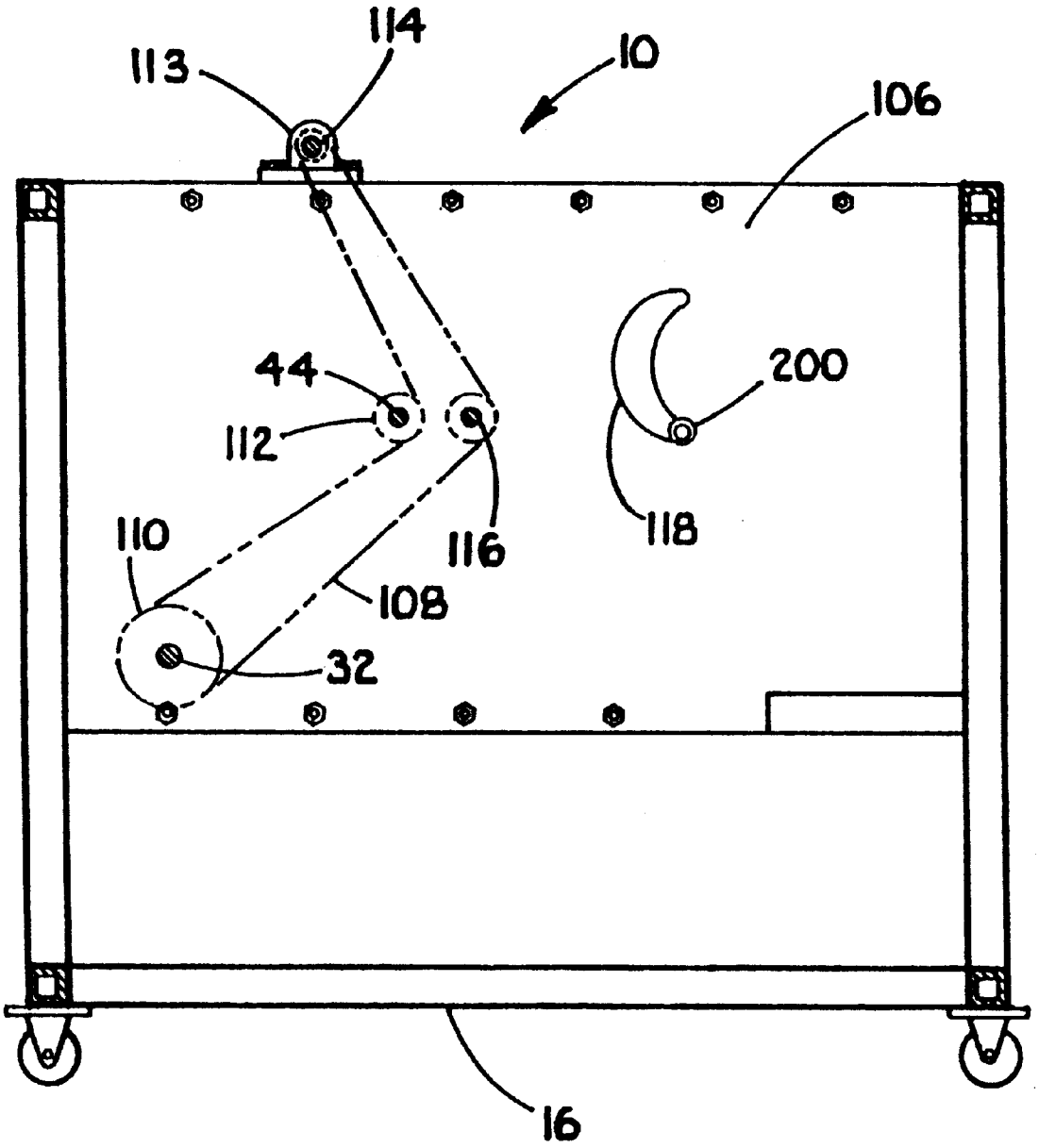
FIG. 3 is a side elevational view.

FIG. 3 depicts a portion of the drive train for compression conveyor 38. A sprocket 110 is attached to one end of shaft 32, which is in turn driven by a variable speed motor. A drive belt or chain 108 is trained between sprocket 110 and sprocket 112, which is connected to shaft 44 of compression conveyor 38. A bearing block 113 supports a return sprocket 114, which is positioned on frame 16 to provide a good catch for drive chain 108 on sprocket 112. Drive chain 108 is returned to sprocket 110 by an idler sprocket 116. Cover 106 has a slot 118 through which a pivot guide 200 for pivot 70B projects. Similarly a pivot guide is provided through a slot in cover 11 for pivot 70A. Pivot guides 200 maintain spacing between compression conveyor 38 and rotary cutting assembly 14 as tires are discharged from between conveyor 38 and support conveyor 26 and conveyor 38 rises. Slot 118 is a semicircle with a diameter equal to the diameter of the largest diameter saw 72 in rotary cutting assembly 14.

Figure 4:
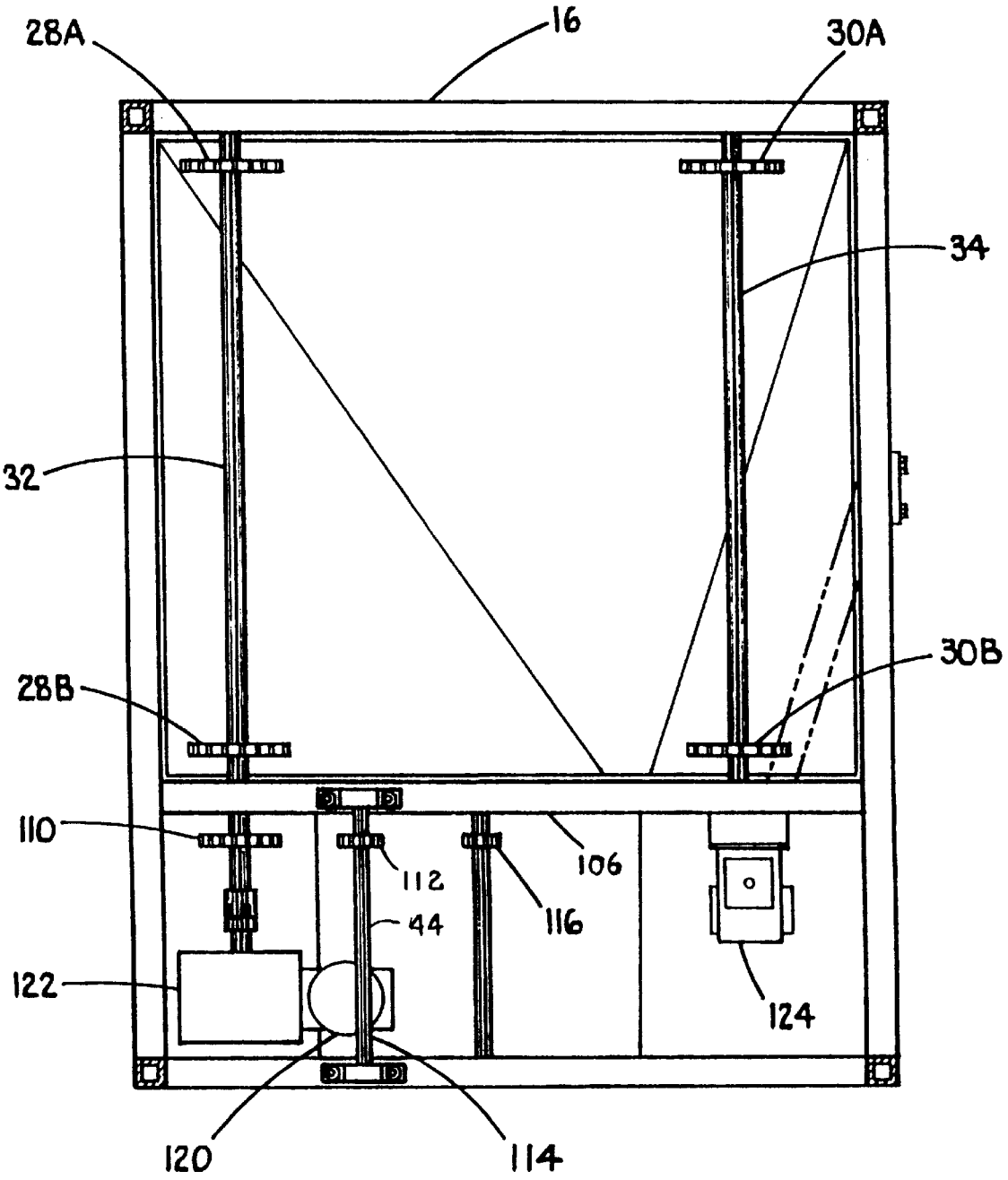
FIG. 4 is a cross-sectional view of the tire shredder.

FIG. 4 depicts the support assembly and the remainder of the drive train for support conveyor 26. Support conveyor is supported between shafts 32 and 34 on sprockets 28A, 28B, 30A and 30B. Shaft 32 is directly coupled by coupler 122 to a variable speed drive motor 120, which also powers compression conveyor 38 described above.

Figure 5:
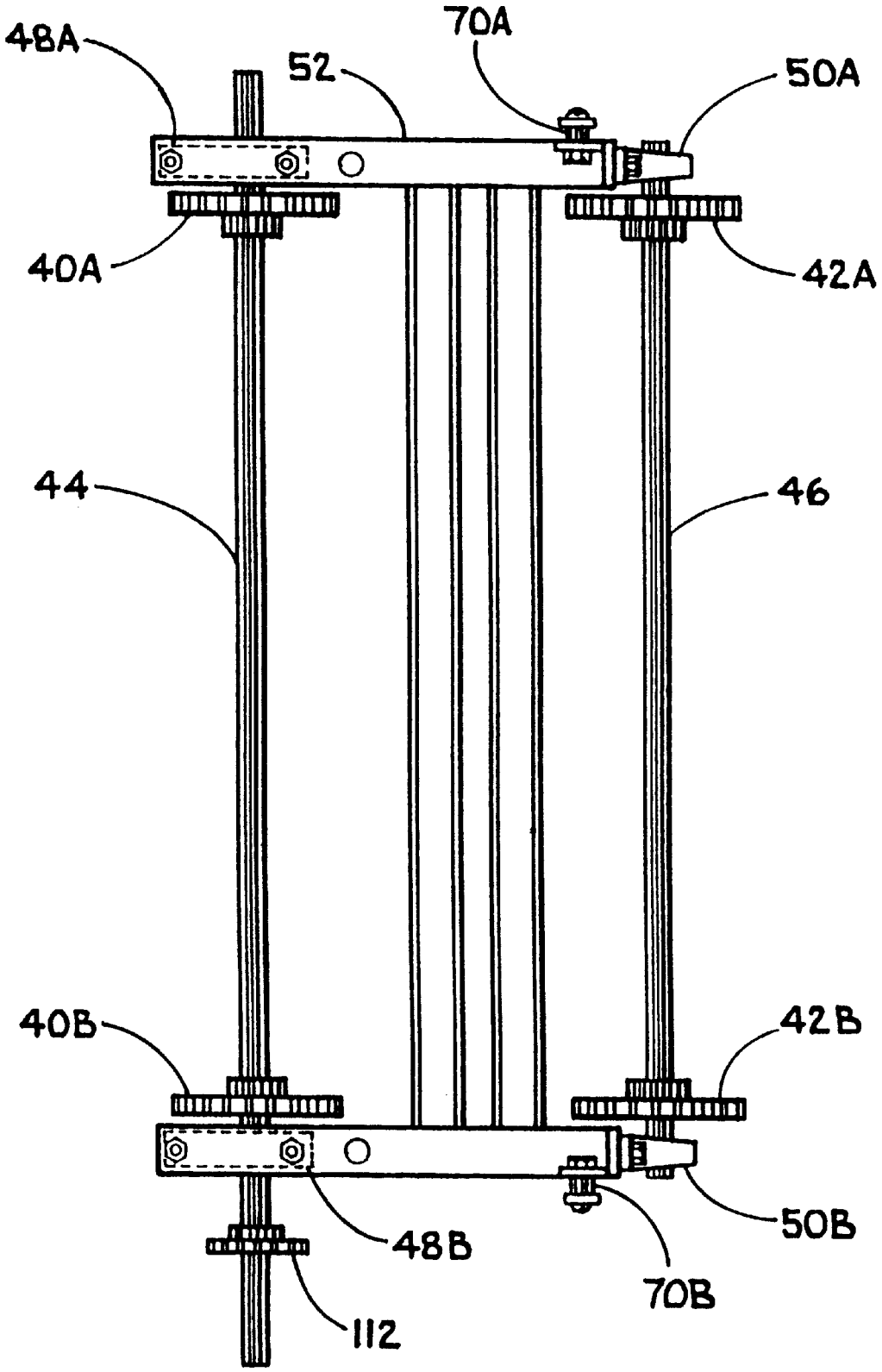
FIG. 5 is a top view of a compression conveyor subframe.

FIG. 5 illustrates subframe 52 and the drive train for compression conveyor 38 in greater detail. Compression conveyor 38 is supported between shafts 44 and 46 on sprockets 40A, 40B, 42A and 42B. As described above, sprocket 112 is attached to one end of shaft 44.

Figure 6A:
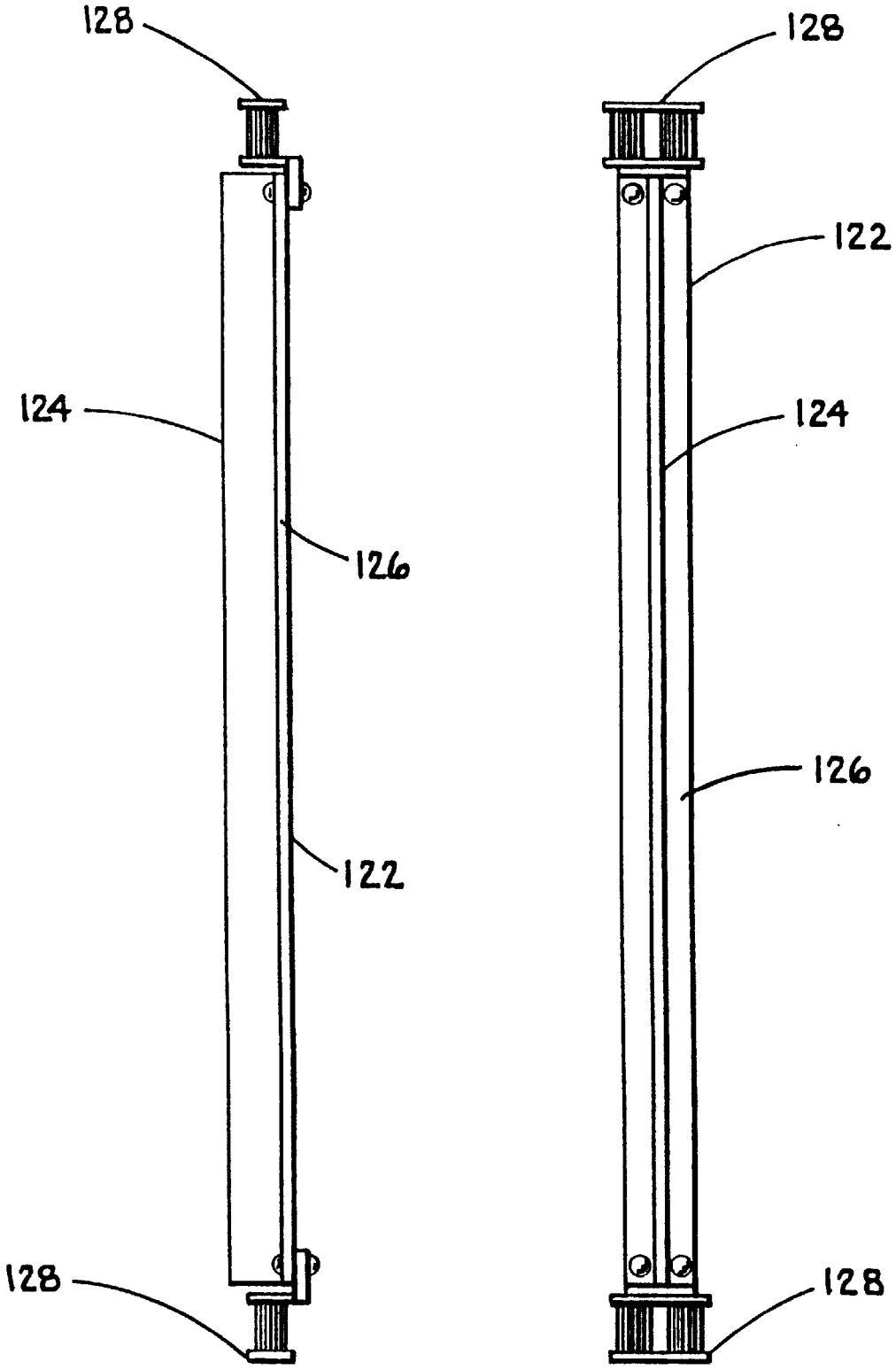
FIG. 6A is two side views of a "T-bar" used to assemble a conveyor belt in compression or support conveyors.

Compression conveyor 38 and support conveyor 26 provide substantial structural rigidity both across and along the surfaces facing tires placed in tire shredder 10. Both conveyors are constructed from double chain linked T-bars 122 illustrated individually in FIG. 6A in side and top views. The "T" shape of the bars provides structural rigidity while orienting the bars so that the leg 124 of the "T" faces outwardly provides for gripping tires on the conveyors. The flat 126 of the "T" provides convenient surfaces for bolting links 128 to each end of T-bars 122.

Figure 6B:
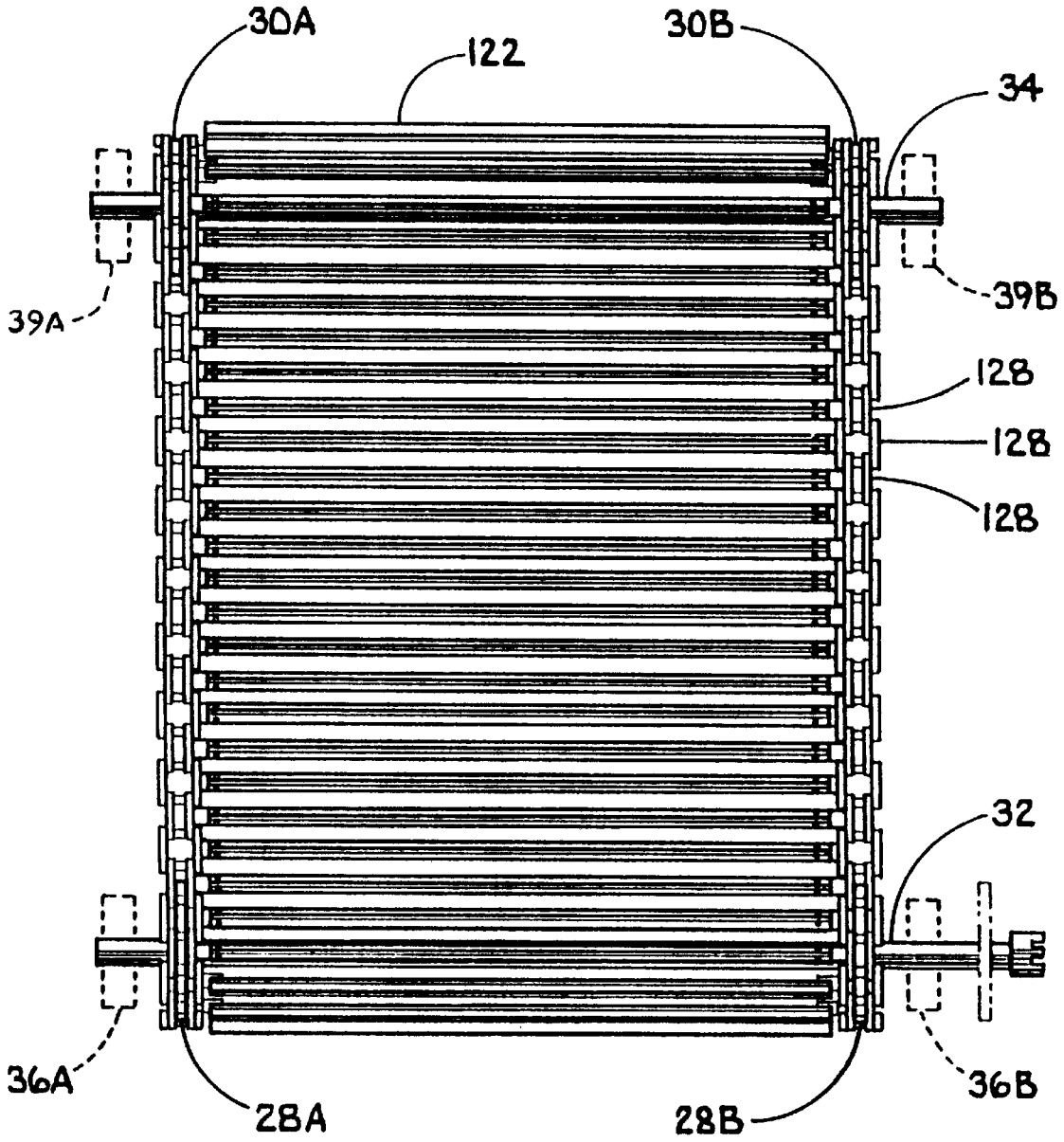
FIG. 6B is a top view of a support conveyor.

FIG. 6B is a top view of support conveyor 26 but is illustrative of the construction of either support conveyor 26 or compression conveyor 38. T-bars 122 are linked side by side in an endless chain around sprockets 28A, 28B, 30A and 30B. The width of links 128 varies to allow side by side linkage of T-bars 122.

Figure 7A:
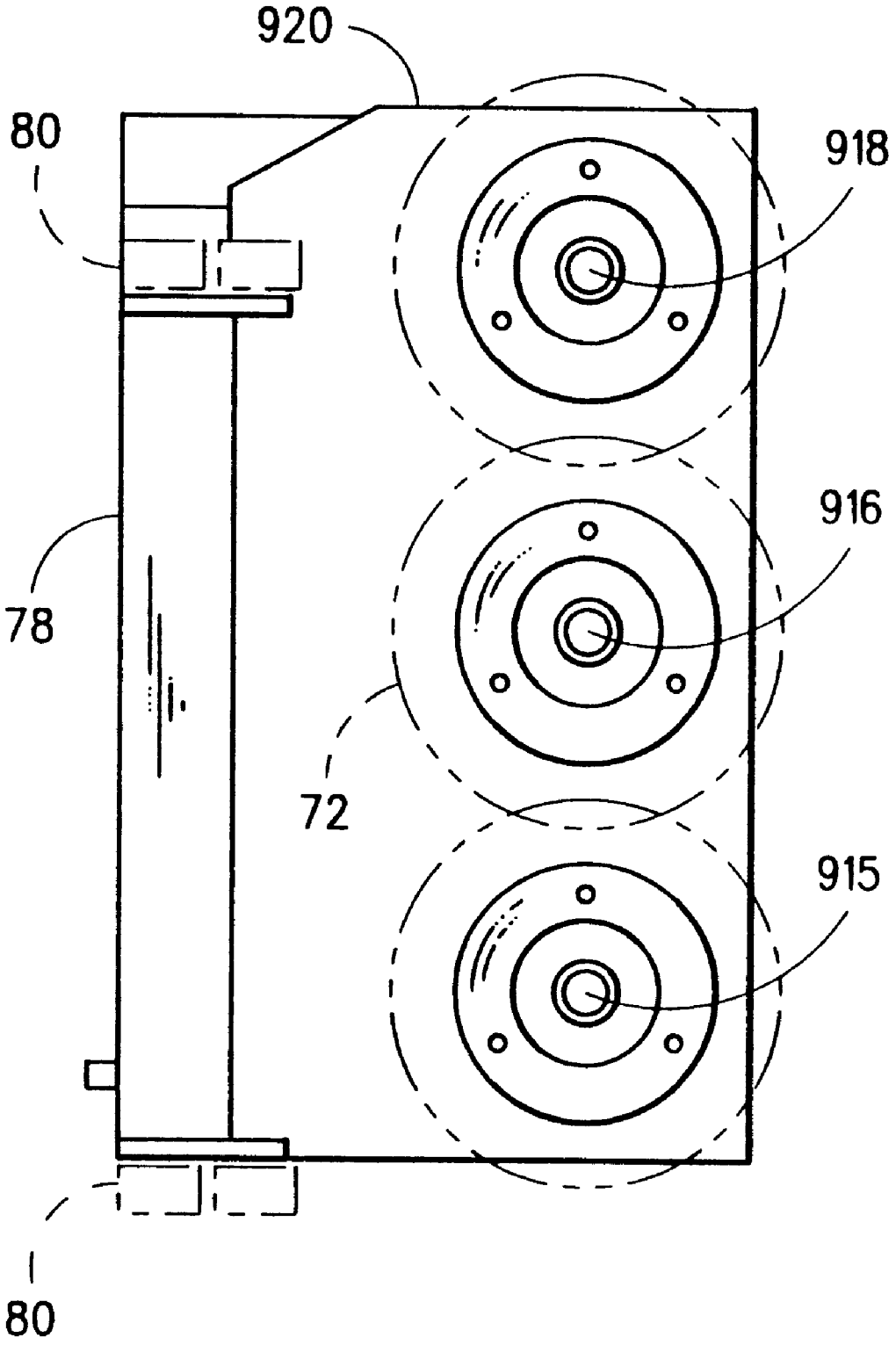
FIGS. 7A–B are side cross-sectional views of a rotary cutter.
Figure 7B:
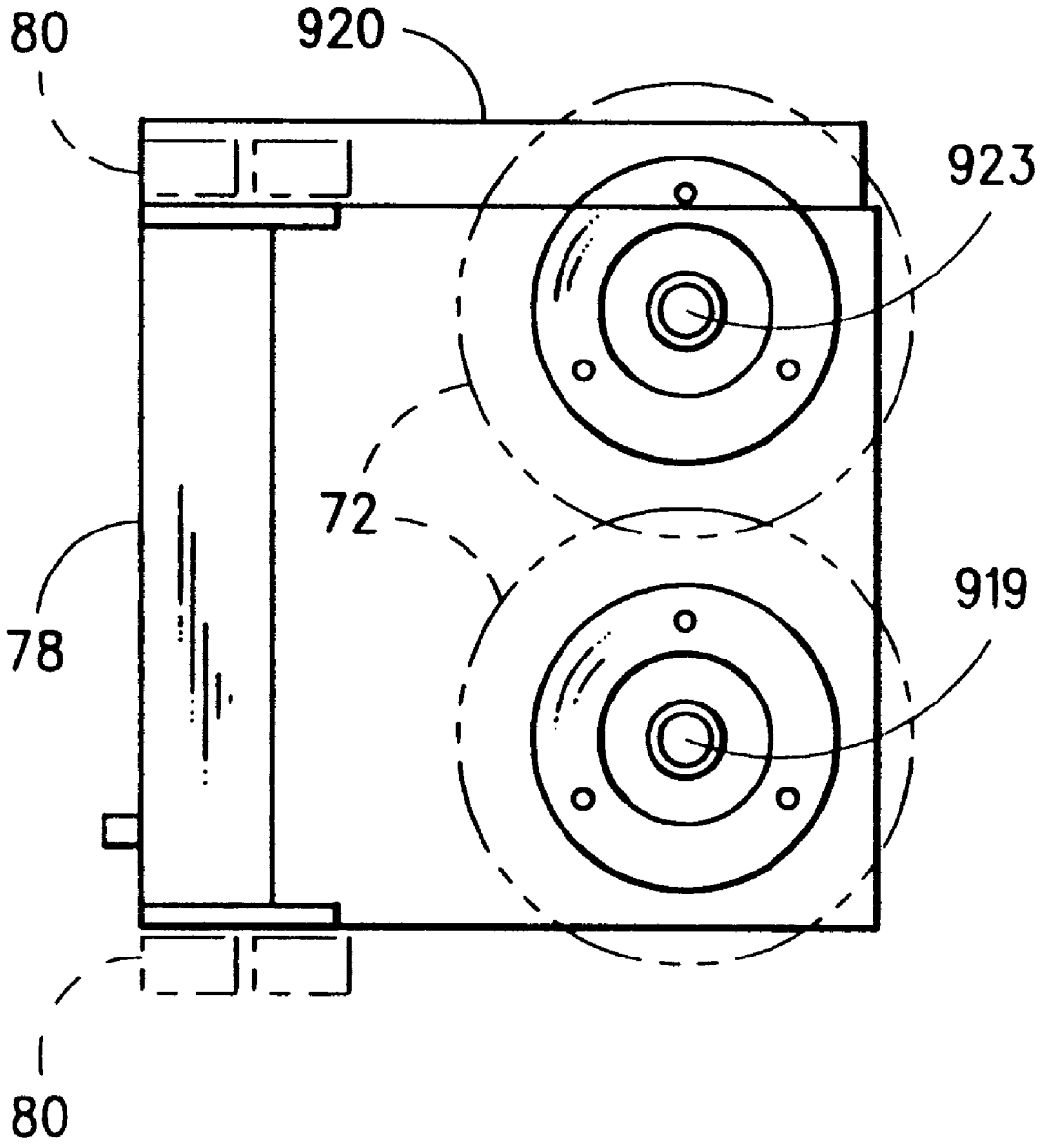

Rotary cutting assembly 14 may be implemented in any of several configurations, two of which are illustrated in FIGS. 7A–7B, which show arrangements for mounting three and two shafts respectively between frames 920 and 921. Carriage 78 may be extended vertically to accommodate as many shafts as desired. However, the vast majority of tires may be processed using a machine having three shafts supporting 6 or 7 inch circular saws 72. For the three shaft version, shafts 915, 916 and 918 are supported for rotation in frame 920. For two shafts, a smaller frame 921 accommodates shafts 919 and 923.

Figure 8A:
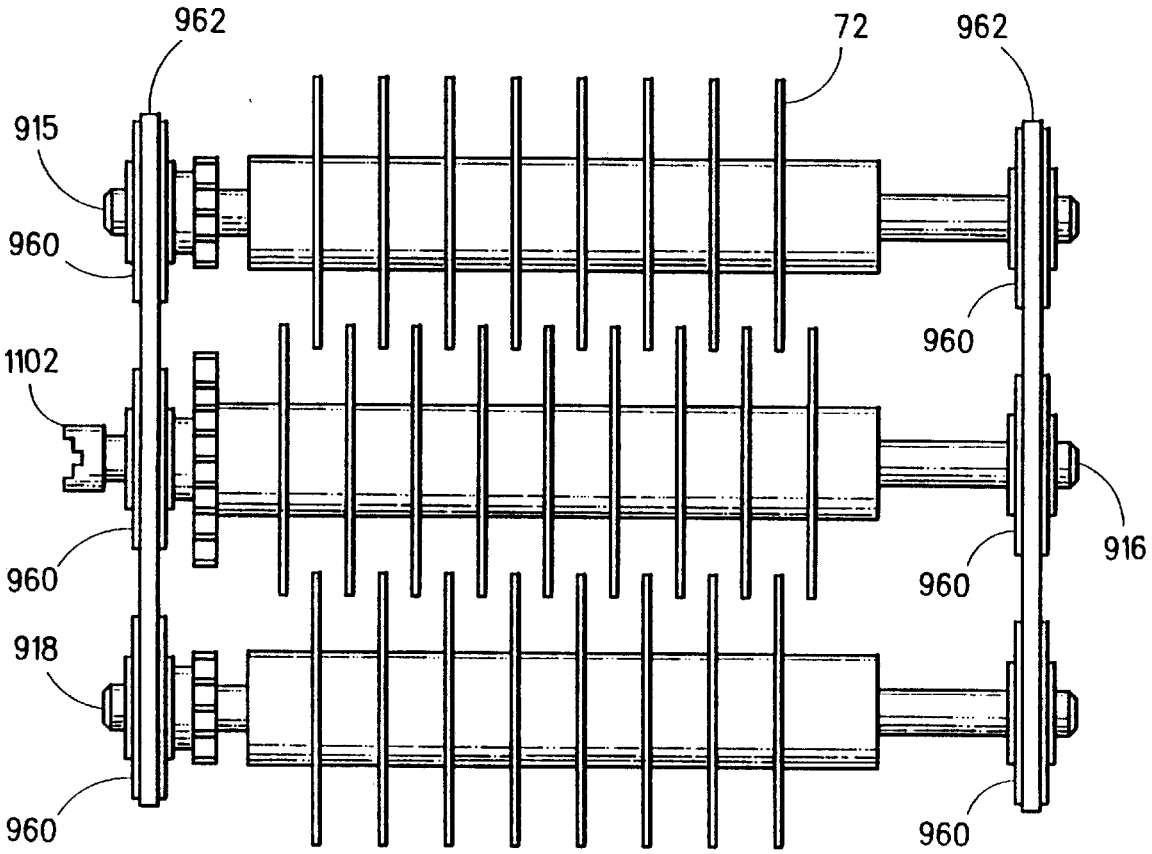
FIGS. 8A–B are elevational views of the rotary cutting assemblies of FIGS. 7A and B, respectively.
Figure 8B:
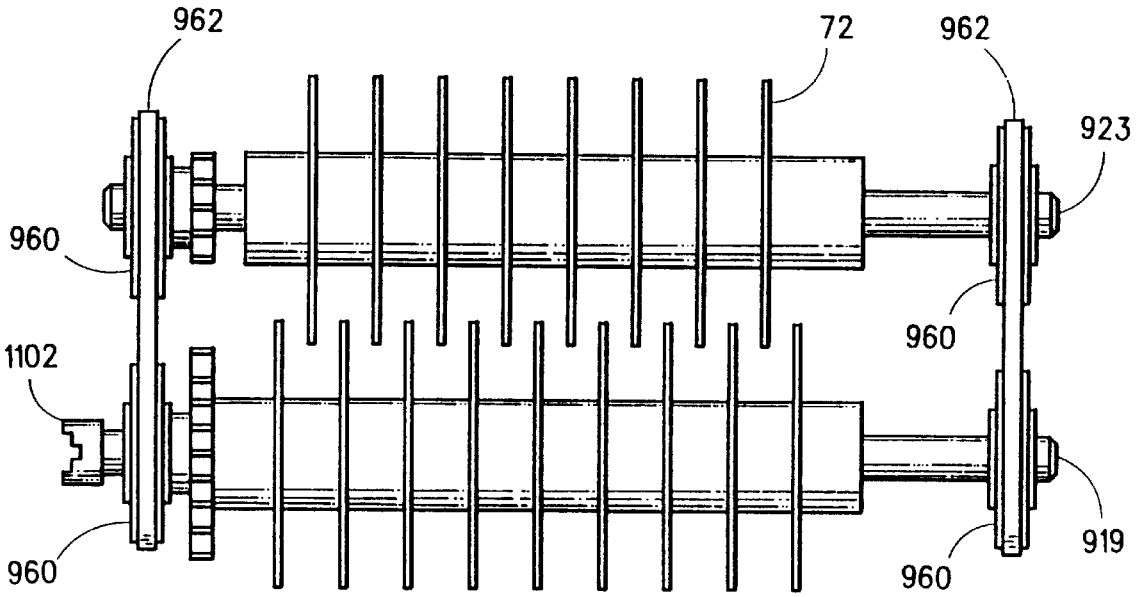

FIGS. 8A and 8B illustrate, in side view, carriage 78 arrangements for three and two shafts, respectively. In FIG. 8A three parallel shafts 915, 916 and 918 support parallel mounted circular saws 72. Circular saws 72 are mounted on shafts 915, 916 and 918 to overlap between adjacent shafts with individual saws from one shaft occupying each interstice between adjacent saws on an adjacent shaft. Sprockets 960 are mounted at opposite ends of each of shafts 915, 916 and 918, allowing a chain or belt 962 to be fitted around the sprockets so that the shafts rotate together. A joint 1102 for connection to a drive motor is mounted at one end of shaft 916 outside of the adjacent sprocket 960.

In FIG. 8B two parallel shafts 919 and 923 support parallel mounted circular saws 72. Circular saws 72 are mounted on shafts 919 and 923 to overlap, with an individual saw from one shaft occupying each interstice between adjacent circular saws on the other shaft. Sprockets 960 are mounted at opposite ends of each of shafts 919 and 923, allowing a chain or belt 962 to be fitted around the sprockets so that the shafts rotate together. A joint 1102 for connection to a drive motor is mounted at one end of shaft 919 outside of the adjacent sprocket 960.

Figure 9:
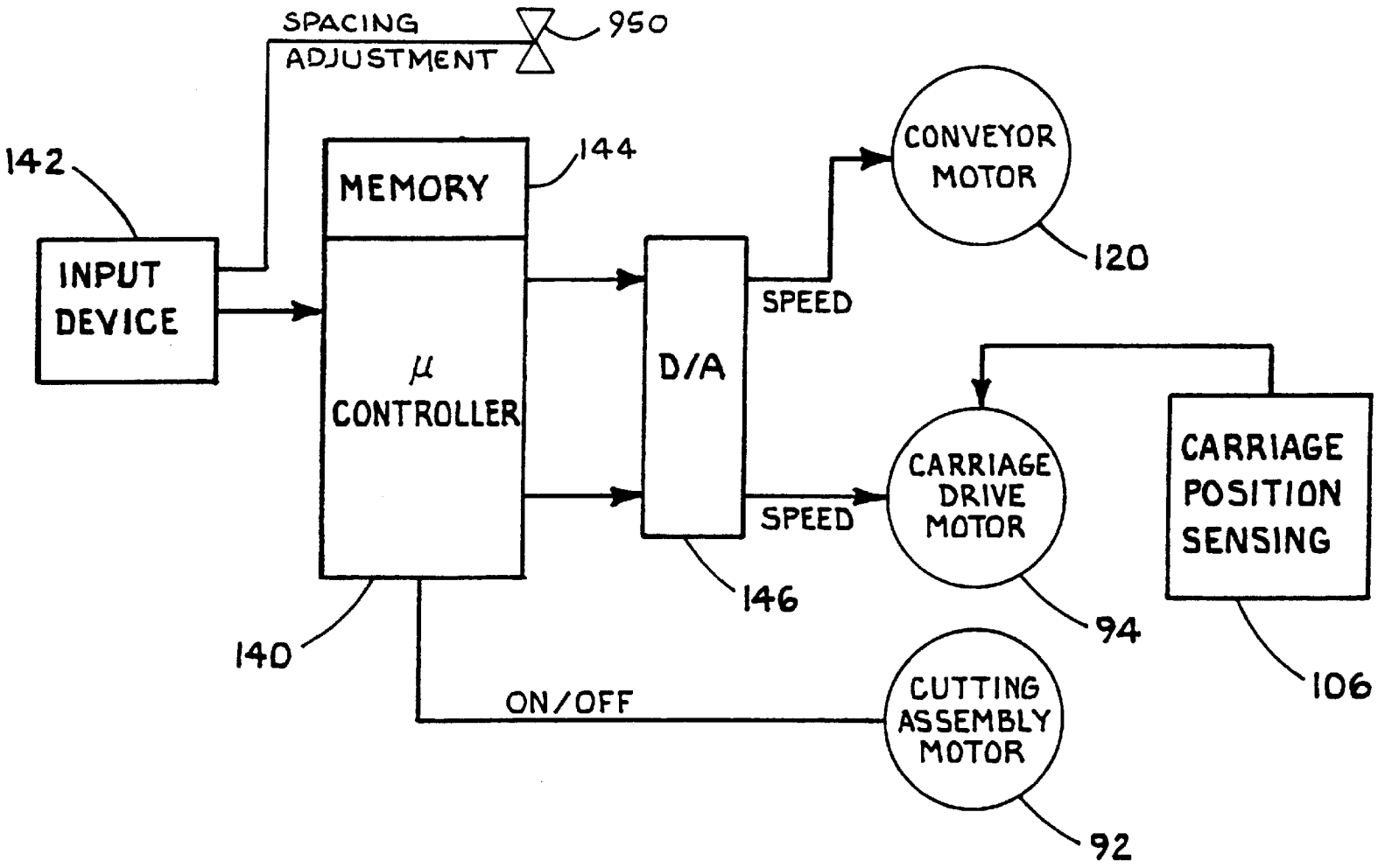
FIG. 9 is a block diagram of a control system for a tire shredder constructed in accordance with the invention.

FIG. 9 is a block diagram schematic of a control system 138 which may be used with tire shredder 10. A microcontroller 140 accepts user inputs from a keypad 142 of the dimensions of a tire being placed into tire shredder 10 to look up preset conveyor motor and carriage drive motor speeds in a look-up table stored in read only memory (ROM) in memory 144. Motor speed signals are passed from microcontroller 140 to digital to analog converter 146 to produce drive signals for conveyor motor 120 and carriage drive motor 94. An on/off signal is applied to the cutting assembly motor 92. Carriage position sensing relays 106 provides direction reversing signals to carriage drive motor 94 limiting the travel of the carriage. Motors 120 and 94 are preferably variable speed direct current motors coupled to the conveyor system 12 and carriage 78 by step down gear boxes. A spacing adjustment signal may be applied from microcontroller 140 to valve 950 to control pressurization of the support adjustment struts 940A and B and thereby control the spacing between the support conveyor 26 and the compression conveyor 38.

SUMMARY

The invention teaches an easily maintained, compact and simple apparatus for shredding automobile tires sufficiently for easy storage and shipping of the debris and for some recycling uses. While the invention is shown in only one of its forms, it is not thus limited but is susceptible to various changes and modifications without departing from the spirit and scope of the invention.

What is claimed is:

1. Apparatus for shredding material comprising:

means for conveying and compressing the material;

a discharge from the means for conveying and compressing;

a carriage mounted with respect to the means for conveying and compressing for reciprocating linear movement across the discharge;

a plurality of shafts mounted for rotation on the carriage, with the axes of rotation of the plurality of shafts being parallel to the direction of reciprocating linear movement; and a plurality of cutting elements on each of the plurality of shafts.

2. Apparatus as set forth in claim 1, wherein the means for compressing and conveying further comprises:

a frame;

a support conveyor supported on the frame;

a compression conveyor;

a suspension system depending from the frame supporting the compression conveyor in a position generally facing the compression conveyor with the support conveyor and the compression conveyor being closer at the discharge end than at the input end;

a conveyor prime mover coupled to drive synchronously the support and compression conveyors; and a position control strut for urging the compression conveyor in a selected direction away from or toward the support conveyor.

3. Apparatus as set forth in claim 2, further comprising:

the support conveyor having a substantially planar travel for carrying material; and the plurality of shafts being arranged in a plane substantially perpendicular to the planar travel of the support conveyor.

4. Apparatus as set forth in claim 3, further comprising:

a pair of parallel rails supported on the frame; and the carriage being movable on the pair of parallel rails.

5. Apparatus as set forth in claim 3, wherein the plurality of cutting elements are circular saws, with the circular saws mounted on any given shaft extending into interstices between the circular saws on all adjacent shafts.

6. Apparatus as set forth in claim 5, wherein the shafts are coupled for rotation.

7. Apparatus for shredding tires and tire debris, comprising:

a frame;

a conveyor assembly depending from frame defining a feed path for the tires and debris from an input end to a discharge end;

a carriage supported with respect to the conveyor assembly to have a reciprocating linear travel across the feed path at the discharge end; and a plurality of rotary cutting elements mounted on the carriage with axes of rotation parallel to the travel of the carriage.

8. Apparatus as set forth in claim 7, wherein the conveyor assembly further comprises:

a support conveyor having a substantially planar conveying surface;

a compression conveyor;

a suspension system depending from the frame supporting the compression conveyor in a position generally facing the compression conveyor with the support conveyor and the compression conveyor being closer at the discharge end than at the input end;

a conveyor prime mover coupled to drive the support and compression conveyors; and a position control strut for urging the compression conveyor in a selected direction toward or away from the support conveyor.

9. Apparatus as set forth in claim 8, wherein each of the plurality of rotary cutting elements comprises:

a shaft set for rotation on the rotation on the carriage;

a plurality of circular saws mounted on the shaft perpendicular to the axis of rotation of the shaft; and means for turning the shaft.

10. Apparatus as claimed in claim 9, wherein the circular saws on adjacent shafts overlap.

* * * * *